US008414742B2

(12) United States Patent
Köckritz et al.

(10) Patent No.: US 8,414,742 B2
(45) Date of Patent: Apr. 9, 2013

(54) PAPER MACHINE CLOTHING

(75) Inventors: Uwe Köckritz, Heidenheim (DE); Hubert Walkenhaus, Kerpen (DE)

(73) Assignee: Voith Patent GmbH, Heidenheim (DE)

( * ) Notice: Subject to any disclaimer, the term of this patent is extended or adjusted under 35 U.S.C. 154(b) by 365 days.

(21) Appl. No.: 12/759,893

(22) Filed: Apr. 14, 2010

(65) Prior Publication Data

US 2010/0263820 A1 Oct. 21, 2010

(30) Foreign Application Priority Data

Apr. 16, 2009 (DE) ..... 10 2009 002 433

(51) Int. Cl.
*D21F 7/08* (2006.01)
*B32B 5/08* (2006.01)
*B32B 5/10* (2006.01)

(52) U.S. Cl.
USPC ..... 162/358.2; 162/900; 442/319

(58) Field of Classification Search ..... 162/116, 162/348, 358.1, 358.2, 361, 900–904; 28/110, 28/141, 142; 139/383 AA, 383 A, 425 A; 442/305, 319
See application file for complete search history.

(56) References Cited

U.S. PATENT DOCUMENTS 4,948,658 A * 8/1990 Halker ..... 442/314
2005/0086833 A1* 4/2005 FitzPatrick ..... 34/611

FOREIGN PATENT DOCUMENTS

DE 10 2008 043 855 A1 5/2010
DE 10 2008 043 917 A1 5/2010

* cited by examiner

*Primary Examiner* — Eric Hug
(74) *Attorney, Agent, or Firm* — Taylor IP, P.C.

(57) ABSTRACT

The invention relates to a clothing especially a press felt for a paper, cardboard or tissue machine with a nonwoven structure comprising staple fibers and which provides the paper and running side of the clothing and with a base structure which is embedded into the nonwoven structure, whereby the base structure comprises a warp knit structure which has sewing threads and reinforcing threads extending lengthways parallel to each other and which have a greater flexural strength than the sewing threads, whereby the sewing threads form loops into which the reinforcing threads are tied thereby forming the warp knit structure. The invention is characterized in that an intermediate layer is arranged at the warp knit structure which is connected with the reinforcing threads by way of the sewing threads.

19 Claims, 2 Drawing Sheets

PAPER MACHINE CLOTHING

BACKGROUND OF THE INVENTION

1. Field of the Invention

The invention relates to a clothing for a paper, cardboard or tissue machine.

2. Description of the Related Art

In addition to the known components such as the nonwoven structure and the base structure which provides the dimensional stability, generic types of clothing, especially press felts, oftentimes include additional functional layers through which for example the rewetting characteristics or the damping characteristics of the clothing can be influenced.

Production of such complex structures requires a multitude of individual manufacturing steps.

What is needed in the art is to further develop a clothing of the type referred to at the beginning in such a way that it can be produced easily and more cost effectively and whereby various modular and functional layers are combined through one manufacturing technology, in order to reduce the expenditure in subsequent manufacturing steps.

SUMMARY OF THE INVENTION

The present invention provides a clothing especially a press felt for a paper, cardboard or tissue machine featuring a nonwoven structure comprising staple fibers which provides the paper and running side of the clothing, and featuring a weight carrying base structure which is embedded into the nonwoven structure, whereby the base structure comprises a warp knit structure which has sewing threads as well as reinforcing threads which extend lengthways parallel to each other and have a greater flexural strength than the sewing threads, whereby the sewing threads form loops into which the reinforcing threads are tied thereby forming the warp knit structure.

The present invention is characterized in that an intermediate layer is arranged at the warp knit structure which is connected with the reinforcing threads by way of the sewing threads.

In this way various functional layers can be combined with the weight carrying base structure through the warp knit method, so that also the stable fibers are tied into the base structure through the sewing threads.

The inventive solution provides a reduction of expenditures during processing of the modules, since process steps can be saved through the combination of various pre-manufactured modules into a complete structure.

In addition, the inventive design of intermediate layer and warp knit structure illustrates a function which improves the tying in of the nonwoven structure to the base structure.

Advantageously the handling of the system can also be influenced positively.

In addition the inventive solution provides that the intermediate layer is already connected during the manufacture of the warp knit structure with it, which is why said structure does not have to be combined with the base structure in a separate process.

The intermediate layer and the warp knit structure extend preferably over the entire width and length of the clothing.

A preferred embodiment of the invention provides that the intermediate layer is denser than the nonwoven structure. "Denser" in this case is understood to mean predominantly that less void volume is present in the intermediate layer than in the layer or in each of the layers in the nonwoven structure. Because of the denser formation of the intermediate layer compared to the nonwoven layer it is possible that the intermediate layer assumes an additional and/or a different function in the inventive clothing compared to the nonwoven layer.

It is for example conceivable that the intermediate layer is permeable.

It is further conceivable that the intermediate layer fulfils a function of reducing or preventing rewetting and/or an increasing dampening.

The intermediate layer can for example be formed by a nonwoven material and/or a film and/or a membrane and/or a fine woven material.

A fine woven material is to be understood to be a woven fabric whose longitudinal and cross threads have a smaller diameter than the reinforcing threads. If the base structure also includes a longitudinal reinforcing module, then the longitudinal and cross threads of the woven fabric are to also have a smaller diameter than the threads forming the longitudinal reinforcing module.

In order to provide a cost effective intermediate layer in one of the structures described above, it is for example conceivable that it is composed of pre-manufactured partial width sections. In order to provide the intermediate layer these are arranged adjacent to each other across the entire width of the clothing, viewed in cross direction of the clothing whereby longitudinal edges of the adjacent sections facing each other can be arranged to abut or partially overlap each other.

Preferably the nonwoven fabric forming the intermediate layer comprises a spun bonded fabric and/or a staple fiber nonwoven fabric. Here the staple fiber nonwoven fabric can be bonded or not bonded.

The nonwoven fabric comprises especially polyurethane. If the nonwoven fabric is a spun bonded fabric then it can be formed especially from polyurethane fibers. Alternatively or in addition to polyurethane the nonwoven fabric can include or may be composed of polyamide and/or polypropylene and/or polyester.

Good results in regard to damping characteristics and/or reduction of rewetting can be achieved if the spun bonded fabric which includes the polyurethane fibers has a basis weight in the range of 20-400 g/m$^2$, especially 40-200 g/m$^2$.

Along their length the reinforcing threads extend straight and especially not curved.

It is conceivable that the reinforcing threads of the warp knit structure are weft threads. In this case the sewing threads form rows of loops, arranged especially parallel to each other and extending essentially vertically to the weft threads, whereby the weft threads are tied into the loops. A warp knit structure of this type is described for example in the German patent application DE 10 2008 043 855.

Alternatively it is also conceivable that the reinforcing threads of the warp knit structure are warp threads.

In addition it is conceivable that the reinforcing threads are warp threads and weft threads.

In this case the warp knit structure has especially first and second sewing threads whereby the first sewing threads progress at an angle or transversely to the warp threads and the second sewing threads form loop rows which progress in longitudinal direction of the warp threads and which envelop these at least in sections and whereby second sewing threads are tied into loops of the first sewing threads. A warp knit structure of this type is described for example in the German patent application DE 10 2008 043 917.

Preferably the warp knit structure essentially provides the transverse stability of the clothing. It is especially conceivable that the reinforcing threads extend over their length at an angle to the longitudinal direction of the clothing, especially in cross direction of the clothing.

If the reinforcing threads extend at an angle to the longitudinal direction or in cross direction of the clothing then essentially no, or only a very slight, stability of the clothing in its longitudinal direction can be provided by them. Therefore it is advantageous in this case if the base structure also includes a longitudinal reinforcement module which essentially provides the longitudinal stability of the clothing. The longitudinal reinforcement module can for example include one or several longitudinal threads—can in particular be formed from these—which extend/s essentially in longitudinal direction of the clothing. If the longitudinal reinforcement module is formed from the longitudinal thread or longitudinal threads respectively, then the longitudinal thread or threads can for example form a laid thread structure which consists of longitudinal thread or threads which extend essentially in longitudinal direction of the clothing and which are spiral wound in cross direction of the clothing. The laid formation of longitudinal threads extends preferably over the entire width and length of the clothing.

The clothing is preferably seamable in the machine whereby at the two ends defining the longitudinal reinforcement module in its length the longitudinal thread or threads forms or form seam loops which, in order to make the clothing continuous, are caused to mesh with each other thus forming a connecting channel through which a pintle wire can be inserted. Since the nonwoven structure is clearly anchored better in the base structure due to the provision of the intermediate layer which is tied in with the warp knit structure by way of its sewing threads compared to clothing of this type known in the current state of the art, and since the seam area is especially sensitive in regard to wear of the nonwoven structure, the inventive clothing is seamable, especially in the paper, cardboard or tissue machine.

The manufacture of the inventive clothing comprises the following steps:

- Provision of a parallel arrangement of reinforcing threads;
- Provision of an intermediate layer and placing of the intermediate layer at the reinforcing threads;
- Joining of the reinforcing threads with each other and with the intermediate layer by way of sewing threads, whereby the sewing threads form loops into which the reinforcing threads are tied in order to form the warp knit structure and into which the intermediate layer is tied;
- Provision of a nonwoven structure which includes staple fibers and placement of the warp knit structure with the intermediate layer which is tied into it in the nonwoven structure.

The nonwoven structure described above can hereby be bonded or not bonded.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
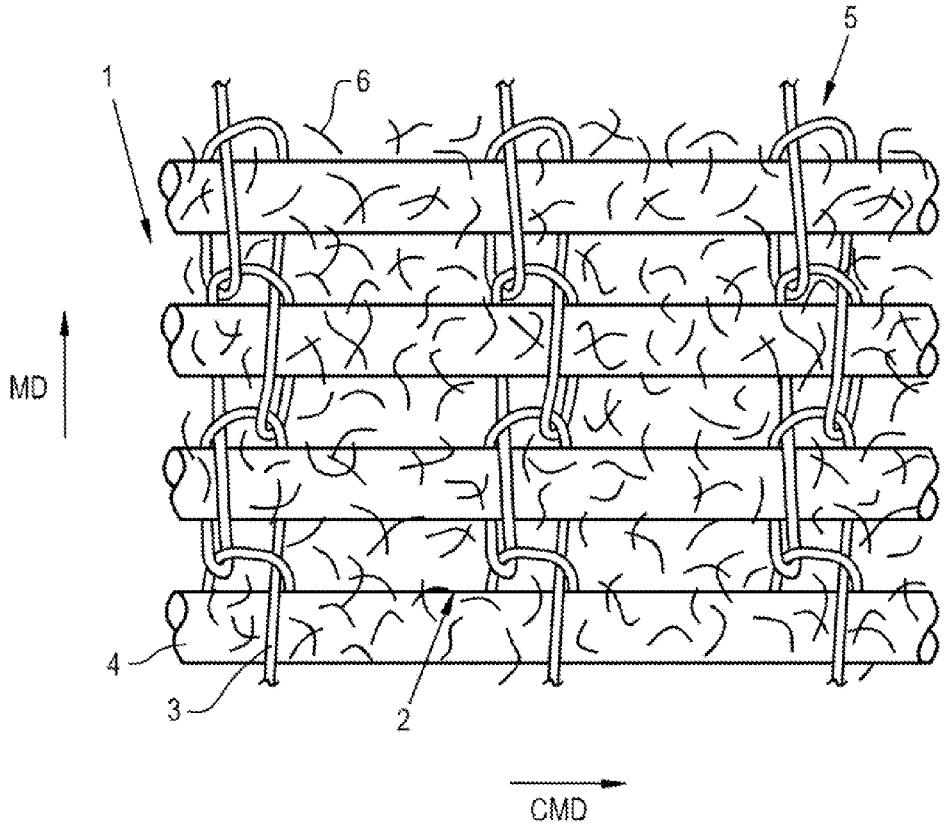
FIG. 1 is a top view of a warp knit structure with intermediate layer.

Referring now to the drawings, and more particularly to FIG. 1, there is shown a warp knit structure with a tied-in intermediate layer 2. Warp knit structure 1 is formed by sewing threads 3 and reinforcement threads 4 extending parallel to each other along their length, whereby reinforcement threads 4 possess a greater flexural strength than sewing threads 3. Sewing threads 3 form loops into which reinforcement threads 4 are tied in order to form warp knit structure 1. In the current example sewing threads 3 form rows 5 of loops which are arranged parallel to each other and extend essentially vertical to reinforcement threads 4 and into which reinforcement threads 4 are tied.

According to the invention intermediate layer 2 is arranged at warp knit structure 1 and is connected by way of sewing threads 3 with the reinforcement threads 4.

Intermediate layer 2 is formed predominantly by a spun bonded fabric which is formed by polyurethane fibers 6. The spun bonded fabric comprising the polyurethane fibers has a basis weight in the range of 20-400 g/m$^2$.

Reinforcement threads 4 of warp knit structure 1 are weft threads extending in cross direction CMD of press felt 7 and hereby progress straight along their length.

Figure 2:
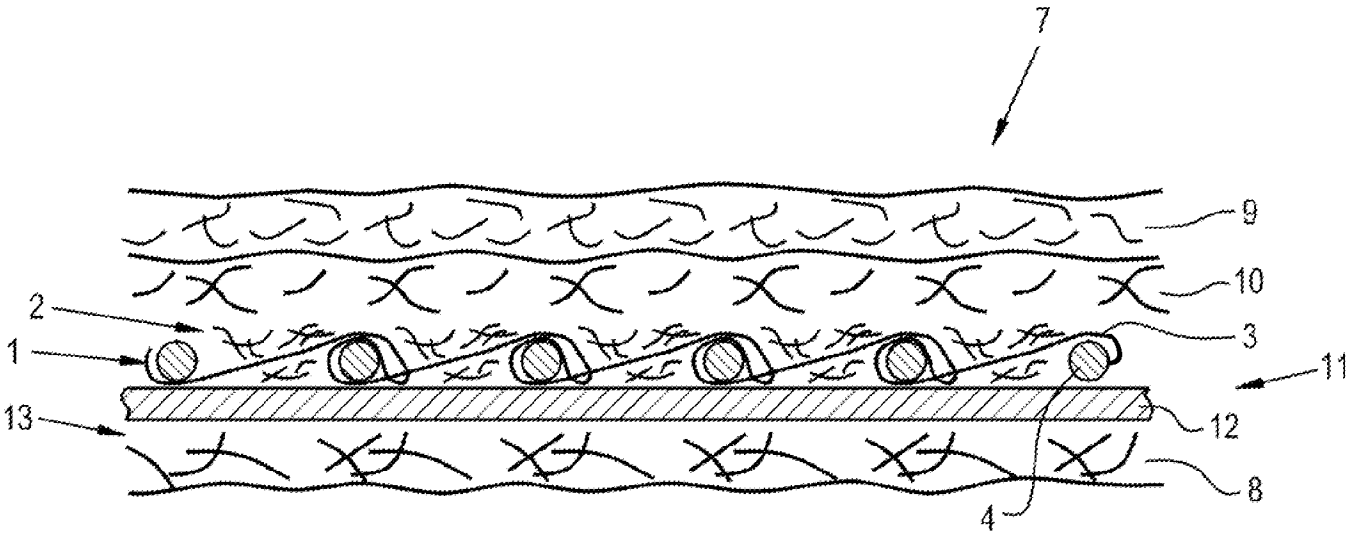
FIG. 2 is an inventive press felt with a warp knit structure according to FIG. 1.

The press felt for a paper, cardboard or tissue machine as illustrated in FIG. 2 has a nonwoven structure comprising staple fibers and is formed by a machine-side nonwoven layer 8, a paper-side nonwoven layer 9 and an intermediate nonwoven layer 10. The press felt also includes a base structure 11 which is embedded into the nonwoven structure and which consists of warp knit structure 1 known from FIG. 1 with intermediate layer 2 as well as longitudinal reinforcement module 13 which is formed by a laid structure of longitudinal threads 12.

Intermediate layer 2 is permeable and in the current example is denser than each of the layers 8-10 of the nonwoven structure. The intermediate layer in the current example also fulfils a function of reducing as well as a function of increasing dampening.

In the current example warp knit structure 2 essentially provides the transverse stability of press felt 7.

Longitudinal reinforcement module 13 also provides essentially the longitudinal stability of press felt 7.

The functionality of the press felt can be further expanded by the modular layers. For example, the influence over rewetting can be adjusted through appropriate flow control. The selection, for example, of polyurethane nonwoven fabric permits targeted influence over the recovery or elasticity of the felt.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A clothing for one of a paper, a cardboard, and a tissue machine, said clothing comprising:

a nonwoven structure including a plurality of staple fibers, said nonwoven structure providing a paper side of the clothing and a running side of the clothing;

a base structure which is embedded into said nonwoven structure, said base structure including a warp knit structure which has a plurality of sewing threads and a plurality of reinforcing threads, said plurality of reinforcing threads extending lengthways parallel to each other and having a greater flexural strength than said plurality of sewing threads, said plurality of sewing threads including a plurality of loops into which said plurality of reinforcing threads are tied and thereby form said warp knit structure; and an intermediate layer which is arranged at said warp knit structure, said intermediate layer being connected with said plurality of reinforcing threads by way of said plurality of sewing threads, said intermediate layer being formed by at least one of a nonwoven material, a film, a membrane, and a fine woven material, said nonwoven material being a nonwoven fabric which forms said intermediate layer, said nonwoven fabric at least one of being a spun bonded fabric and including a staple fiber nonwoven fabric.

2. The clothing according to claim 1, wherein the clothing is a press felt.

3. The clothing according to claim 1, wherein said intermediate layer is denser than said nonwoven structure.

4. The clothing according to claim 1, wherein said intermediate layer is permeable.

5. The clothing according to claim 1, wherein said intermediate layer is configured for at least one of (a) one of reducing and preventing rewetting, and (b) increasing dampening.

6. The clothing according to claim 1, wherein said nonwoven fabric one of includes and consists of at least one of polyurethane, polyamide, polyester, and polypropylene.

7. The clothing according to claim 1, wherein said spun bonded fabric one of includes and consists of at least one of polyurethane, polyamide, polyester, and polypropylene.

8. The clothing according to claim 7, wherein said spun bonded fabric has a basis weight in a range of 20 $g/m^2$-400 $g/m^2$.

9. The clothing according to claim 7, wherein said spun bonded fabric has a basis weight in a range of 40 $g/m^2$-200 $g/m^2$.

10. The clothing according to claim 1, wherein said plurality of reinforcing threads of said warp knit structure are a plurality of weft threads.

11. The clothing according to claim 10, wherein said plurality of sewing threads form a plurality of rows of said plurality of loops, said plurality of rows of said plurality of loops being arranged parallel to each other and extending essentially vertically relative to said plurality of weft threads, said plurality of weft threads being tied into said plurality of loops.

12. The clothing according to claim 1, wherein said plurality of reinforcing threads of said warp knit structure are a plurality of warp threads.

13. The clothing according to claim 12, wherein said plurality of sewing threads of said warp knit structure includes a plurality of first sewing threads and a plurality of second sewing threads, said plurality of first sewing threads progressing one of at an angle to and transversely to said plurality of warp threads, said plurality of second sewing threads forming a plurality of loop rows which progress in a longitudinal direction of said plurality of warp threads and which envelop said plurality of warp threads at least in a plurality of sections, said plurality of first sewing threads including a plurality of loops into which said plurality of second sewing threads are tied.

14. The clothing according to claim 1, wherein said warp knit structure essentially provides a transverse stability of the clothing.

15. The clothing according to claim 1, wherein said plurality of reinforcing threads have a length and extend over said length at an angle to a longitudinal direction of the clothing.

16. The clothing according to claim 15, wherein said plurality of reinforcing threads have a length and extend over said length in a cross direction of the clothing.

17. The clothing according to claim 1, wherein said base structure includes a longitudinal reinforcement module which essentially provides a longitudinal stability of the clothing.

18. The clothing according to claim 17, wherein said longitudinal reinforcement module one of has and is formed from a plurality of longitudinal threads which extend essentially in a longitudinal direction of the clothing.

19. The clothing according to claim 18, wherein the clothing is seamable in one of the paper, the cardboard, and the tissue machine, said longitudinal reinforcement module including a length and two ends which define said longitudinal reinforcement module in said length, at said two ends said plurality of longitudinal threads forming a plurality of seam loops which, in order to make the clothing continuous, mesh with each other to thereby form a connecting channel configured for inserting a pintle wire therethrough.

* * * * *